US010550811B2

(12) United States Patent
Flarup

(10) Patent No.: US 10,550,811 B2
(45) Date of Patent: Feb. 4, 2020

(54) FUEL VALVE FOR A LARGE TWO-STROKE SELF-IGNITING INTERNAL COMBUSTION ENGINE

(71) Applicant: MAN ENERGY SOLUTIONS, FILIAL AF MAN ENERGY SOLUTIONS SE, TYSKLAND, Copenhagen SV (DK)

(72) Inventor: Johannes Flarup, Vanloese (DK)

(73) Assignee: MAN ENERGY SOLUTIONS, FILIAL AF MAN ENERGY SOLUTIONS SE, TYSKLAND, Copenhagen SV (DK)

( * ) Notice: Subject to any disclaimer, the term of this patent is extended or adjusted under 35 U.S.C. 154(b) by 0 days.

(21) Appl. No.: 15/569,591

(22) PCT Filed: Apr. 18, 2016

(86) PCT No.: PCT/DK2016/050106
§ 371 (c)(1),
(2) Date: Oct. 26, 2017

(87) PCT Pub. No.: WO2016/169568
PCT Pub. Date: Oct. 27, 2016

(65) Prior Publication Data

US 2018/0298859 A1 Oct. 18, 2018

(30) Foreign Application Priority Data

Apr. 22, 2015 (DK) ..... 2015 00247

(51) Int. Cl.
*F02M 61/10* (2006.01)
*F02M 63/00* (2006.01)
*F02M 61/20* (2006.01)

(52) U.S. Cl.
CPC ..... *F02M 61/10* (2013.01); *F02M 61/205* (2013.01); *F02M 63/0005* (2013.01)

(58) Field of Classification Search
CPC .. F02M 61/10; F02M 63/0005; F02M 61/205; F02M 47/02; F02M 51/0657; F02M 51/0682
(Continued)

(56) References Cited

U.S. PATENT DOCUMENTS 5,452,858 A 9/1995 Tsuzuki et al.
5,884,848 A 3/1999 Crofts et al.
(Continued)

FOREIGN PATENT DOCUMENTS

CH 484364 A 1/1970
CN 102691605 A 9/2012
(Continued)

OTHER PUBLICATIONS

International Search Report, Application No. PCT/DK2016/050106, dated Jul. 13, 2016, 2 pages.
(Continued)

*Primary Examiner* — Jason J Boeckmann
(74) *Attorney, Agent, or Firm* — Ziegler IP Law Group, LLC

(57) ABSTRACT

A fuel valve for injecting fuel into the combustion chamber of a large two-stroke self-igniting internal engine combustion engine, with a valve needle that is resiliently biased towards a valve seat. The effective pressure surface that causes fuel pressure to urge the valve needle in the opening direction increases significantly when the valve needle has lift from the valve seat. A supplementary effective pressure surface is provided on the valve needle. The supplementary effective pressure surface creates a force urging the valve
(Continued)

needle towards the valve seat when the supplementary effective pressure surface is exposed to fuel pressure.

11 Claims, 5 Drawing Sheets

(58) Field of Classification Search
USPC ..... 239/533.2, 533.9, 584, 585.5
See application file for complete search history.

(56) References Cited

U.S. PATENT DOCUMENTS

| | | | | |
|---|---|---|---|---|
| 6,454,189 | B1 * | 9/2002 | Krishnamurthy .... | F02M 47/027 239/533.11 |
| 6,722,579 | B1 | 4/2004 | Mattes et al. | |
| 6,820,827 | B1 | 11/2004 | Boecking | |
| 2004/0134539 | A1 | 7/2004 | Ressel et al. | |
| 2006/0289681 | A1 | 12/2006 | Boecking | |

FOREIGN PATENT DOCUMENTS

| | | | |
|---|---|---|---|
| CN | 104454192 | A | 3/2015 |
| DE | 759420 | C | 11/1953 |
| DE | 19815918 | A1 | 10/1999 |
| EP | 2503138 | A1 | 9/2012 |
| EP | 2604847 | A2 | 6/2013 |
| EP | 3009628 | A1 | 4/2016 |
| JP | S6027779 | A | 2/1985 |
| JP | 2012202408 | A | 10/2012 |
| KR | 20120109296 | A | 10/2012 |
| RU | 2486364 | C2 | 6/2013 |
| WO | 9717540 | A1 | 5/1997 |

OTHER PUBLICATIONS

International Preliminary Report on Patentability, Application No. PCT/DK2016/050106, dated Jul. 6, 2017, 49 pages.

* cited by examiner

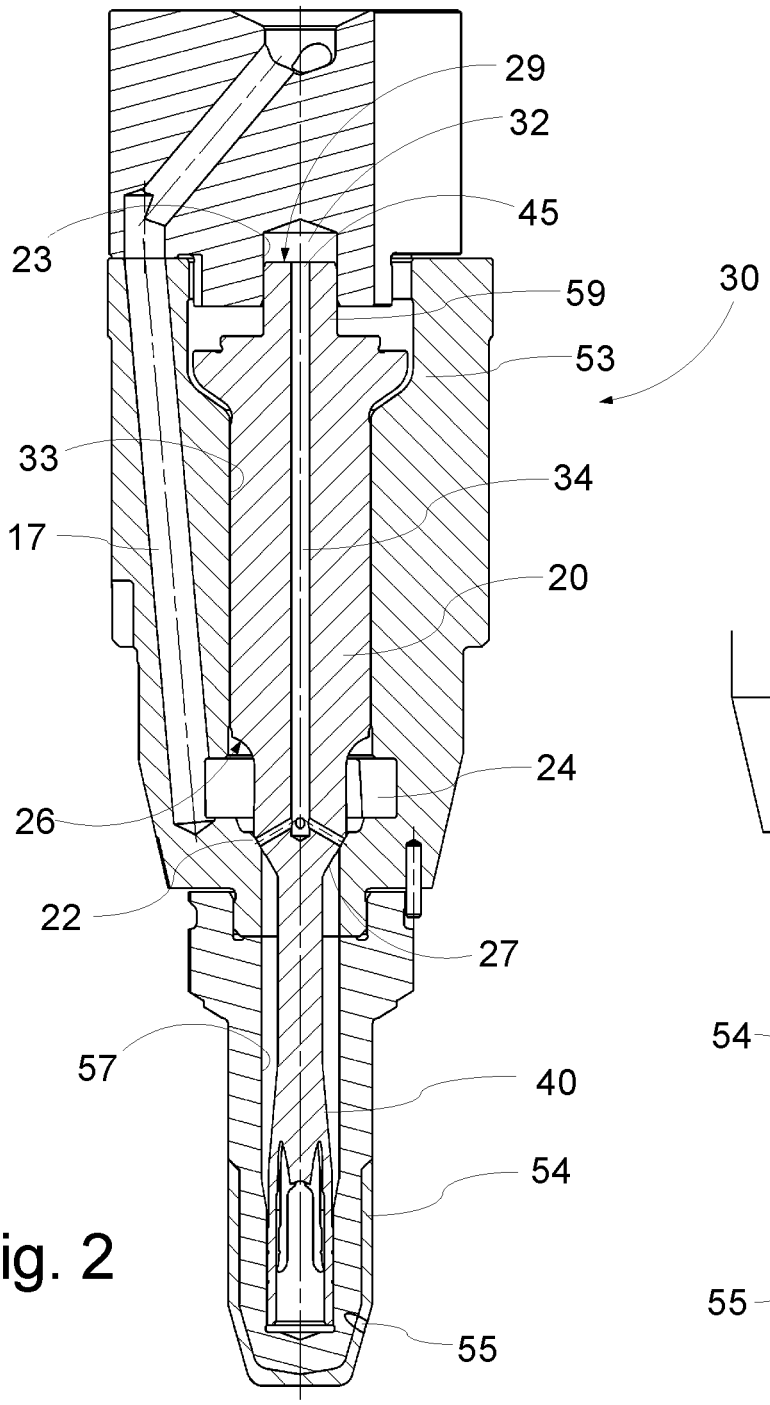
Fig. 2
Fig. 3
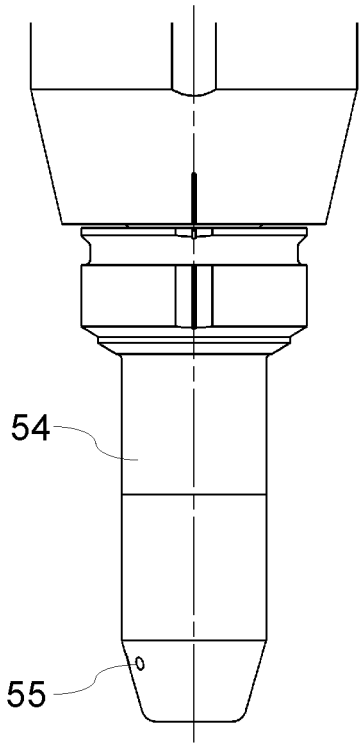

FUEL VALVE FOR A LARGE TWO-STROKE SELF-IGNITING INTERNAL COMBUSTION ENGINE

The present disclosure relates to a fuel valve for large two-stroke self-igniting internal combustion engines, in particular to a fuel valve for injecting fuel oil into the combustion chamber of a large turbocharged two-stroke uniflow internal combustion engine with crossheads.

BACKGROUND

Large two-stroke internal combustion engines are typically used as prime movers in large ocean going ships, such as container ships or in power plants.

These engines are typically provided with two or three fuel valves arranged in each cylinder cover. A conventional fuel valve, as shown in FIG. 1, has a longitudinal axis that is arranged roughly at an angle of 10 to 15 deg to the direction of the movement of the piston in the cylinder of the engine. The fuel valve is provided with a nozzle at its front end that projects into the combustion chamber. The nozzle is provided with axial bore and a plurality of nozzle holes that direct the fuel away from the cylinder walls and into the combustion chamber. Typically, there is a swirl in the scavenging air in the combustion chamber at the time of injection and most of the nozzle holes are directed to inject the fuel with the flow of the swirl although one of the nozzle holes may be directed to inject the fuel into the swirl.

The fuel valve is provided with a spring biased valve needle that acts as a displaceable valve member. When the pressure of the fuel exceeds a preset pressure, e.g. 350 bar the valve needle is lifted from its seat and the fuel is allowed to flow to the combustion chamber via the nozzle at the front of the fuel valve.

The maximum combustion pressure of a large two-stroke self-igniting turbocharged internal combustion engine is very high, e.g. 200 bar and it is therefore difficult under an injection event to provide fuel at a pressure that is significantly higher than the combustion pressure.

Known fuel valves for large 2-stroke self-igniting turbocharged internal combustion engines have a construction that causes the closing pressure, i.e. the pressure at which the valve needle returns to its seat to be lower than the opening pressure, i.e. the pressure at which the valve needle gets lift from its seat. This is due to the fact that the effective pressure surface that acts in the opening direction of the valve needle against the bias of a spring or other resilient means increases at the moment that the valve gets lift from the valve seat. Thus, the valve needle will not return to its seat before the pressure in the fuel valve falls significantly below the pressure at which the fuel valve opened. The resulting low-pressure at the end of the injection event can result in the fuel not being injected with sufficient pressure through the nozzle holes, thereby resulting in less than optimal combustion for the fuel that is injected during the last part of the injection event.

DISCLOSURE

On this background, the aspects of the present application to provide a fuel valve that overcomes or at least reduces the drawbacks mentioned above.

According to a first aspect the aspects of the disclosed embodiments provide a fuel valve for injecting fuel into the combustion chamber of a large two-stroke self-igniting internal combustion engine, the fuel valve comprising:

an elongated valve housing with a rear end and a front end, a hollow nozzle with a first axial bore, a plurality of nozzle holes and a closed front, the nozzle being arranged at the front end of the valve housing, an axially displaceable valve needle slidably received in a second axial bore in the valve housing, the valve needle being configured to control the flow of fuel to the nozzle, the valve needle cooperates with a valve seat in the valve housing and the valve needle being resiliently biased towards the valve seat by a resilient bias, a pressure chamber upstream of the valve seat surrounds a portion of the valve needle and is connected to a fuel inlet port in the valve housing, the valve needle allowing flow of fuel from the pressure chamber to the nozzle when the valve needle has lift from the valve seat and the valve needle preventing flow of fuel from the pressure chamber to the nozzle when the valve needle rests on the valve seat, the valve needle when resting on the valve seat having a first effective pressure surface that under influence of fuel pressure causes a first force on the valve needle opposing the resilient bias, the force causing the valve needle to lift from the valve seat when a pressure in the pressure chamber exceeds a preset pressure threshold, the valve needle when having lift from the valve seat having an additional second effective pressure surface that under influence of fuel pressure causes an additional second force on the valve needle opposing the resilient bias when the valve needle has lift from the valve seat, the valve needle being provided with a third effective pressure surface that under influence of fuel pressure causes a third force on the valve needle joining the resilient bias when and only when the valve needle has lift from the valve seat.

By providing the third effective pressure surface that assists the resilient biasing means in urging the valve needle towards the valve seat, it becomes possible to compensate completely or partially for the fact that the effective pressure surface that creates a force under the influence of pressurized fuel urge the valve member away from the valve seat is significantly increased from the moment that the valve needle has lift from the valve seat. Thus, the negative effect of the increased effective pressure surface that results in a lower closing pressure than opening pressure can be partially or completely removed. Consequently, it is possible to design a fuel valve with a closing pressure that is equal to the opening pressure or only slightly lower than the opening pressure. With such a design, the injection pressure can be kept high throughout the injection event, ensuring proper injection of the fuel into the combustion chamber throughout an injection event.

According to a first implementation of the first aspect the third effective pressure surface has a size causing the third force to compensate substantially for the additional second force.

According to a second implementation of the first aspect the third effective pressure surface faces a second pressure chamber that is defined between the valve needle and the valve housing.

According to a third implementation of the first aspect the second pressure chamber is connected to the first pressure chamber or to the first axial bore, preferably only when the valve needle has lift.

According to a fourth implementation of the first aspect the second pressure chamber is connected to the first pressure chamber or to the first axial bore by a pressure conduit in the valve needle.

According to a fifth implementation of the first aspect a first end of the pressure conduit opens to the second pressure chamber and a second end of the pressure conduit opens to the first axial bore or to a portion of the surface of the valve needle that is in contact with the valve seat when the valve needle rests on the valve seat.

According to a sixth implementation of the first aspect a second opening is closed when the valve needle rests on the valve seat.

According to a seventh implementation of the first aspect the portion of the valve needle that is in contact with the valve seat when the valve needle rests on the valve seat, are in sealing contact around the second end.

According to an eighth implementation of the first aspect the second pressure chamber is defined by a third axial bore in the valve needle and a plunger that is received in the third axial bore.

According to a ninth implementation of the first aspect the first plunger is static and wherein the plunger sealingly fits inside the third axial bore.

According to a tenth implementation of the first aspect the second pressure chamber is defined by a fourth axial bore in the valve housing and a second plunger that is received in the fourth axial bore.

According to an eleventh implementation of the first aspect the second plunger is static and the plunger sealingly fits inside the fourth bore.

According to a twelfth implementation of the first aspect the nozzle is provided with a plurality of nozzle holes distributed over the side of the nozzle, preferably with all or at least most of the nozzle holes being closely angularly spaced.

According to a thirteenth implementation of the first aspect the fuel valve further comprises a hollow cut-off shaft moving in unison with the valve needle and received axially displaceable in the axial bore in the nozzle for opening and closing the nozzle holes, the cut-off shaft being preferably provided with a plurality of openings corresponding to the plurality of nozzle holes so as to connect the nozzle holes to the interior of the hollow cut-off shaft in one position of the hollow cut-off shaft and to disconnect the nozzle holes from the interior of the hollow cut-off shaft in another position of the hollow cut-off shaft.

According to a fourteenth implementation of the first aspect the valve housing being provided with a head at its rearmost end for mounting the fuel valve in a cylinder cover of a cylinder of a large two-stroke self-igniting engine combustion engine.

According to a second aspect, the aspects of the disclosed embodiments provide a fuel valve for injecting fuel into the combustion chamber of a large two-stroke self-igniting internal engine combustion engine, with a valve needle that is resiliently biased towards a valve seat, an effective pressure surface on the valve needle that causes fuel pressure to urge the valve needle in the opening direction increases significantly when the valve needle has lift from the valve seat, a supplementary effective pressure surface is provided on the valve needle, the supplementary effective pressure surface creates a force urging the valve needle towards the valve seat when the supplementary effective pressure surface is exposed to fuel pressure.

Further objects, features, advantages and properties of the fuel valve according to the present disclosure will become apparent from the detailed description.

BRIEF DESCRIPTION OF THE DRAWINGS

In the following detailed portion of the present description, the fuel valve will be explained in more detail with reference to the exemplary embodiments shown in the drawings, in which:

FIG. 2 is a longitudinal-section on a larger scale through the foremost part of the fuel valve illustrated in FIG. 1, the foremost part of the fuel valve being in accordance with an example embodiment and the valve needle being shown resting on the valve seat, FIG. 3 is a side view on a larger scale through of a nozzle of the fuel valve shown in FIG. 2, with the valve needle having lift from the valve seat

DETAILED DESCRIPTION

Figure 1:
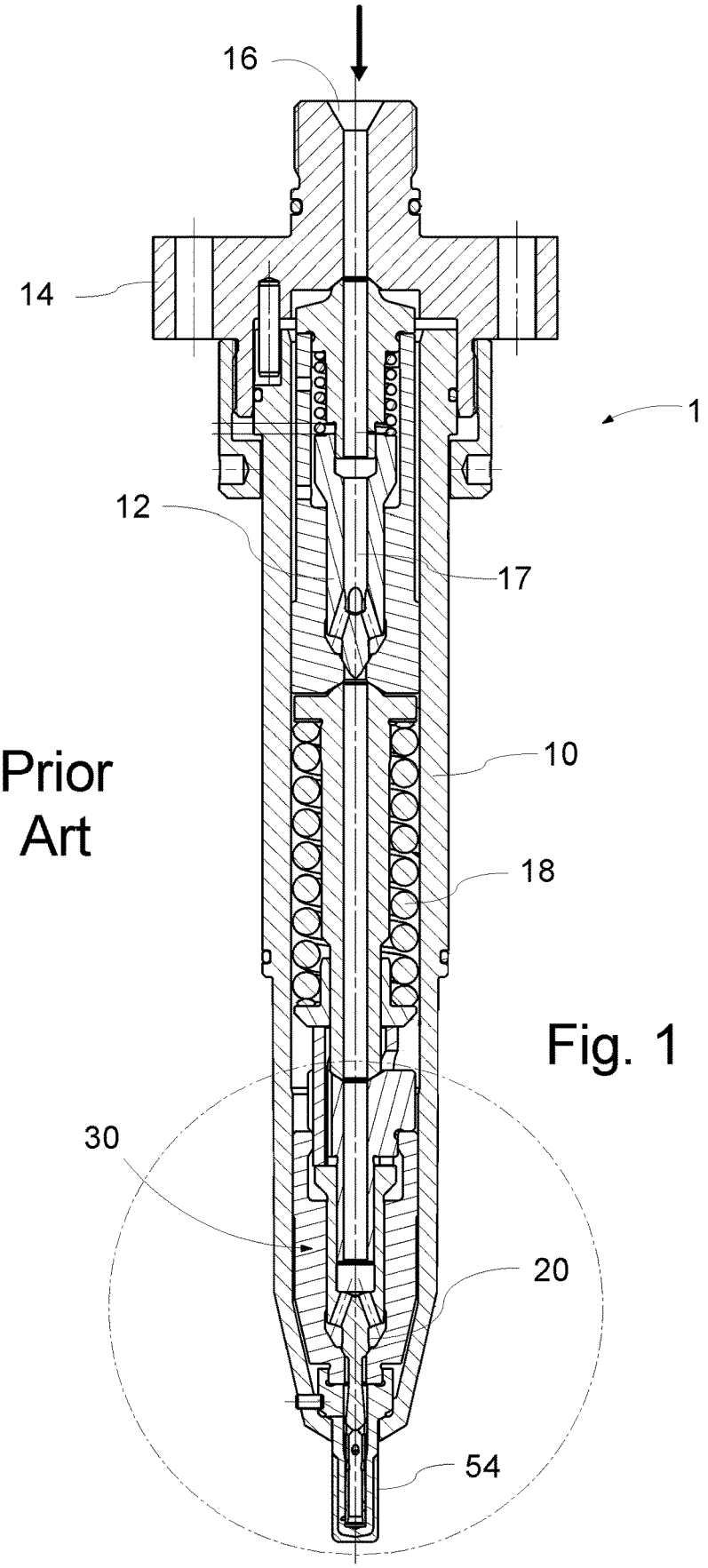
Prior Art Fig. 1
FIG. 1 is a longitudinal-section of an prior art fuel valve.

FIG. 1 illustrates a known fuel valve 1 for injecting fuel, such as e.g. fuel oil or heavy fuel oil or similar fuel into the combustion chamber of a large two-stroke self-igniting internal engine combustion engine. The fuel valve 1 illustrated in FIG. 1 has an elongated housing 10 which at its rearmost end has a head by which the fuel valve 1 in a known manner using bolts may be secured to the cylinder cover of a large two stroke diesel engine and be connected with a fuel pump (not shown). The head 14 includes a fuel oil inlet 16 which is in flow connection with a duct 17. The duct 17 extends through a non-return valve 12 to a valve needle axially displaceable in the valve housing 10. The valve needle 20 is biased to its seat 22 by a closing spring 18, such as e.g. a helical wire spring. The front end of the valve housing 10 holds a hollow nozzle 54 with a preferably closed tip that projects through the valve housing 10 and into the combustion chamber of the engine cylinder (not shown) when the fuel valve 1 is mounted on the cylinder cover. The hollow nozzle 54 has a first axial bore 57, a plurality of nozzle holes 55 and a closed front.

Figure 4:
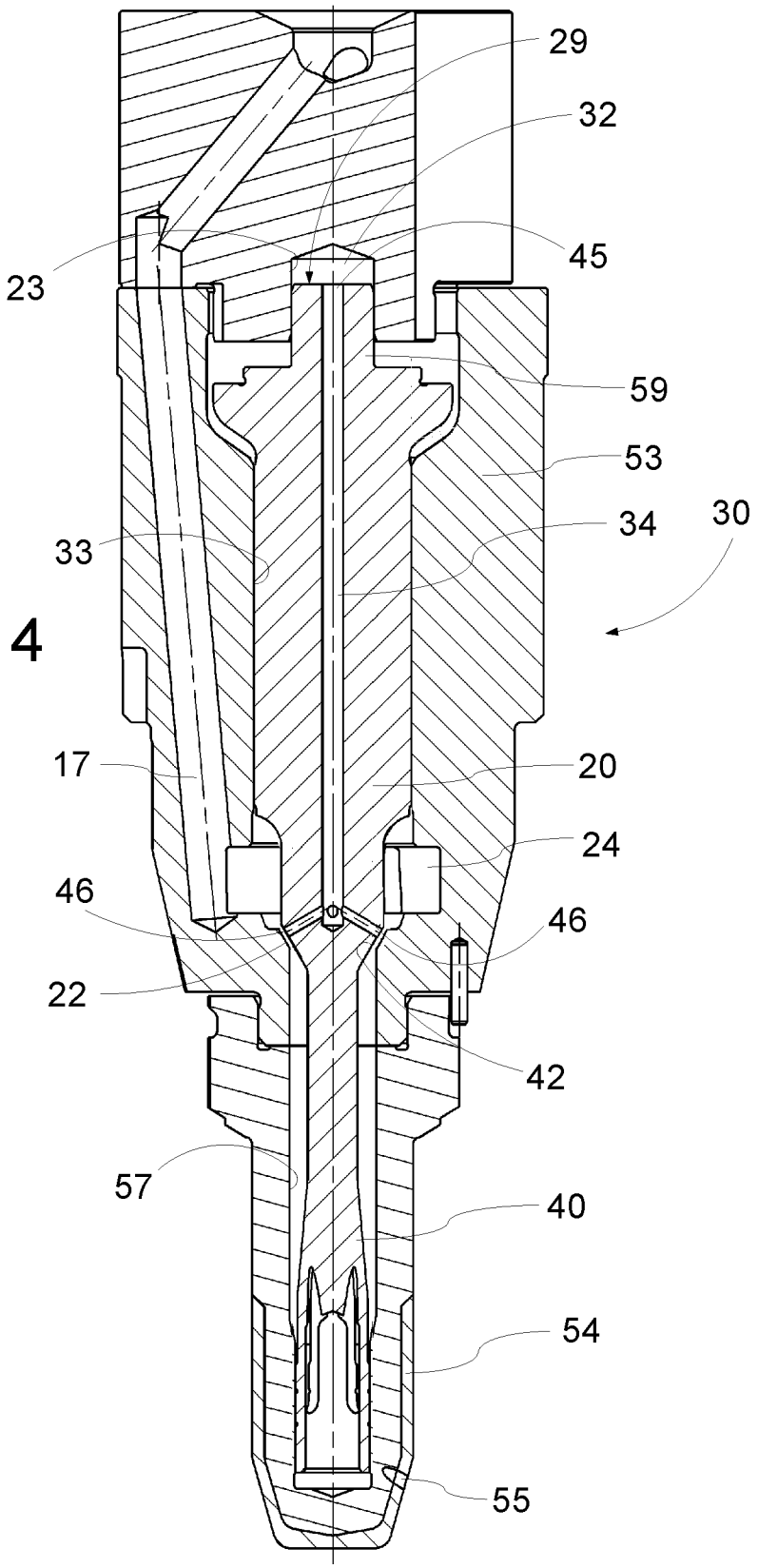
FIG. 4 is a longitudinal-section on a larger scale through the foremost part of the fuel valve illustrated in FIG. 1, the foremost part of the fuel valve being in accordance with the example embodiment of FIG. 2 and the valve needle being shown having lift from the valve seat.
Figure 5:
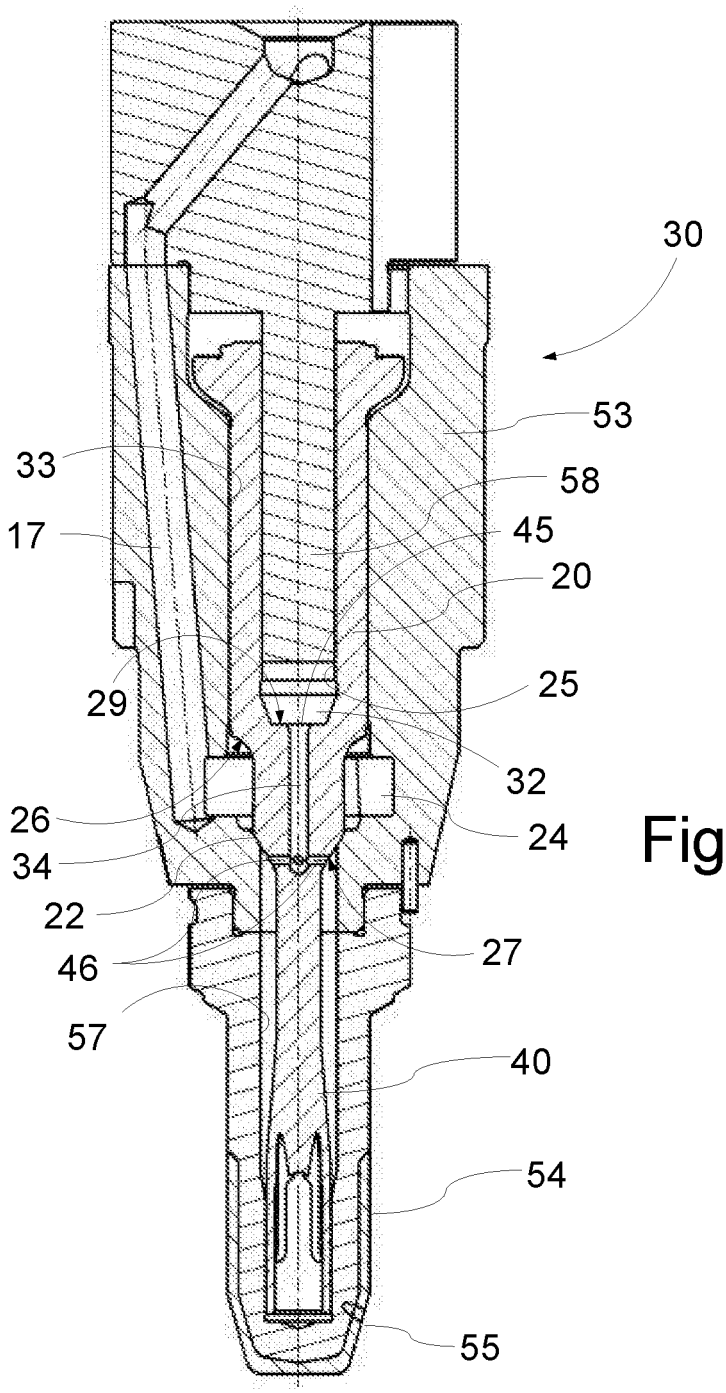
FIG. 5 is a longitudinal-section on a larger scale through the foremost part of the fuel valve illustrated in FIG. 1, the foremost part of the fuel valve being in accordance with another example embodiment and the valve needle being shown resting on the valve seat.

FIGS. 2 to 4 show the foremost part 30 of the fuel valve housing 10 (the part in the interrupted line circle in FIG. 1) with the valve needle 20 and the nozzle 54 in greater detail and in accordance with an example embodiment. The closing spring 18 urges the valve needle 20 to its seat 22. FIG. 2 shows the valve needle 20 resting on the valve seat 22. In this position fluid flow of fuel from the fuel oil inlet 16 to the nozzle 54 is blocked. FIG. 5 shows the valve needle 20 having lift from the valve seat 22. In this position fluid flow of fuel from the fuel oil inlet 16 to the nozzle is not obstructed by the valve needle 20.

The valve needle 20 carries a foremost cut-off shaft 40 that is thinner than the rearmost section of the valve needle 20 and the cut-off shaft 40 projects into a first axial bore 57 in the nozzle 54.

The nozzle 54 is provided with the first axial bore 57 and with a plurality of nozzle holes 55 through which the fuel is injected into the combustion chamber. Thus, during the fuel injection a jet of fuel comes from each of the nozzle holes 55.

In an example embodiment (not shown) the nozzle bores 55 are distributed over the nozzle 54 so as to distribute them with a space between them along the longitudinal extent. In the shown embodiment holes are only spread over the radial extent of the nozzle. In an example embodiment, the nozzle bores 55 are spread radially and radially directed in different but closely spaced directions so as to cover a sector of the combustion chamber with fuel jets coming from the nozzle bores 55.

The cut-off shaft 40 is in an example embodiment made as one piece of material with the valve needle 20. The cut-off shaft 40 is hollow and the hollow interior of the cut-off shaft 40 connects to the space downstream of the valve seat 22. Thus, when the valve needle 20 is lifted from its seat the flow path 17 extends all the way from the fuel oil inlet 16 to the hollow interior of the cut-off shaft 40.

The axially displaceable valve needle 20 is slidably received in a second axial bore 33 in the valve housing 10, i.e. in the spindle guide 53 in the most foremost part 30 of the valve housing 10. The valve needle 20 is configured to control the flow of fuel to the nozzle 54. The valve needle 20 cooperates with a valve seat 22 in the valve housing and the valve needle 20 is resiliently biased towards the valve seat 22 by a resilient bias, generated e.g. by the closing spring 18. The valve seat 22 preferably includes a conical surface for abutting with a cooperating surface on the valve needle 20. A portion 42 of the surface of the valve needle is shaped to sealingly engage the conical surface of the valve seat 22.

A first pressure chamber 24 is arranged just upstream of the valve seat 22 and surrounds a portion of the valve needle 20 and is connected to the fuel inlet port 16 via a duct 17. The valve needle 20 allows flow of fuel from the pressure chamber 24 to the nozzle 54 when the valve needle 20 has lift from the valve seat 22 and the valve needle 20 prevents flow of fuel from the pressure chamber 24 to the nozzle 54 when the valve needle 20 rests on the valve seat 20, The valve needle 20 when resting on the valve seat 22 has a first effective pressure surface 26 that under influence of fuel pressure causes a first force on the valve needle 20 opposing the resilient bias, i.e. the force in the direction of lift. The first effective pressure surface 26 is exposed to pressure in the first pressure chamber 24, and when the pressure of the fuel in the first pressure chamber 24 exceeds a preset fuel pressure threshold, the valve needle 20 is lifted from the valve seat 22 against the resilient bias.

When the valve needle 20 has lift from the valve seat 22, an additional second effective pressure surface 27 of the valve needle 20 becomes active. The second effective pressure surface 27 is disposed on the valve needle 20 where the valve needle 20 engages the valve seat 22 and slightly more forward therefrom. The second effective pressure surface 27 is affected by fuel pressure in the first bore 57 downstream of the valve seat 22 and by fuel pressure in the transition between the first pressure chamber 24 and the first axial bore 57. The second effective pressure surface 27 causes an additional second force on the valve needle 20 opposing the resilient bias when there is pressurized fuel in the first bore 57, i.e. when the valve needle 20 has lift from the valve seat 22.

The valve needle 20 is provided with a third effective pressure surface 29 that under influence of fuel pressure causes a third force on the valve needle 20 joining the resilient bias when the valve needle 20 has lift from the valve seat 22. The third force acts in the same direction as the resilient bias i.e. in the opposite direction of the first force and second force.

Preferably, the third effective pressure surface 29 has a size (effective surface area) causing the third force to compensate substantially for the additional second force. The size of the third effective pressure surface 29 can be chosen such that the closing pressure of the fuel valve is slightly below the opening pressure of the fuel valve.

The third effective pressure surface 29 faces a second pressure chamber 32 that is defined between the valve needle 20 and the valve housing 10, i.e. in the foremost part 30 of the valve housing 10. The second pressure chamber 32 is connected to the first pressure chamber 24 only when the valve needle 20 has lift. Hereto, the second pressure chamber 32 is connected to the first pressure chamber 24 by a pressure conduit 34 in the valve needle 20.

A first end 45 of the conduit 34 opens to the second pressure chamber 32 and a second end 46 of the conduit 34 opens to the portion 42 of the surface of the valve needle 20 that is in contact with the valve seat 22 when the valve needle 20 rests on the valve seat 22. In the present embodiment the conduit 34 is provided with two second openings 46 that are arranged at diametrically opposite sides of the valve needle 20. However, it is understood that a single second opening 46 can suffice.

Thus, the second opening(s) 46 (are) is closed when the valve needle 20 rests on the valve seat 22. This is ensured by the portion 42 of the valve needle 20 and the surface of the valve seat 22 that is in contact with this portion 42 when the valve needle 20 rests on the valve seat 22, are in sealing contact around the second end 46.

The second pressure chamber 32 is arranged in a fourth axial bore 23 in the valve housing 10, i.e. in the most forward part 30 of the valve housing 10. A second plunger 59 is a part of the valve needle 20 is received in the fourth axial bore 23 and delimits the second pressure chamber 32. The second plunger 59 fits sealingly inside the fourth axial bore 23.

Thus, in operation, the valve needle 20 is lifted from its seat when the pressure of the fuel supplied to the fuel valve 1 exceeds a preset pressure threshold. At this moment the pressure in the first pressure chamber 24 acting on the first effective pressure surface 26 creates a force in the lift direction that is sufficiently large to overcome the resilient bias of the closing spring 18 and the valve needle 20 is lifted from the valve seat 22

Thus, the fuel can flow past the valve seat 22 into the first axial bore 57 and into the hollow cut-off shaft 40, and through the nozzle holes 55 into the combustion chamber.

When the pressurized fuel enters the first axial bore 57 the pressurized fuel now also acts on the second effective pressure surface 27 and the second force generated by the pressure acting on the second effective pressure surface 27 joins the first force.

When the valve needle 20 gets lift, the second openings 46 are no longer closed and the third pressure chamber 32 thus becomes pressurized. Thus, the third effective pressure surface 29 is affected by pressurized fuel and generates a third force that joins the resilient bias in urging the valve needle 20 towards the valve seat 22.

When the supply of fuel to the fuel valve 1 is discontinued at the end of the fuel injection process the reduced fuel pressure can no longer keep the valve needle 20 from its valve seat 22 and the closing spring 18 urges the valve needle 20 axially forward to the valve seat 22. Due to the presence of the third effective pressure surface 29, the valve needle 20 will return to its seat at a closing pressure that can be decided through selection of the size of the third effective pressure surface 29. In an embodiment the size of the third effective pressure surface 29 is chosen such that the closing pressure is slightly less than the opening pressure.

Since the cut-off shaft 40 moves in unison with the valve needle 20, the cut-off shaft 40 also moves axially towards the front of the fuel valve 1.

FIG. 5 illustrates another embodiment of the invention that is essentially identical to the embodiment described above, except that the second pressure chamber is defined by a third axial bore 25 in the valve needle 20 and a plunger 58 that is received in the third axial bore 25. The first plunger 58 is static and fits sealingly inside the third axial bore.

Further, the second end(s) 46 is (can be) placed such that it opens towards the first bore 57 and in this embodiment the second end 46 is not closed when the valve needle 20 rests on the valve seat 22.

Figure 6:
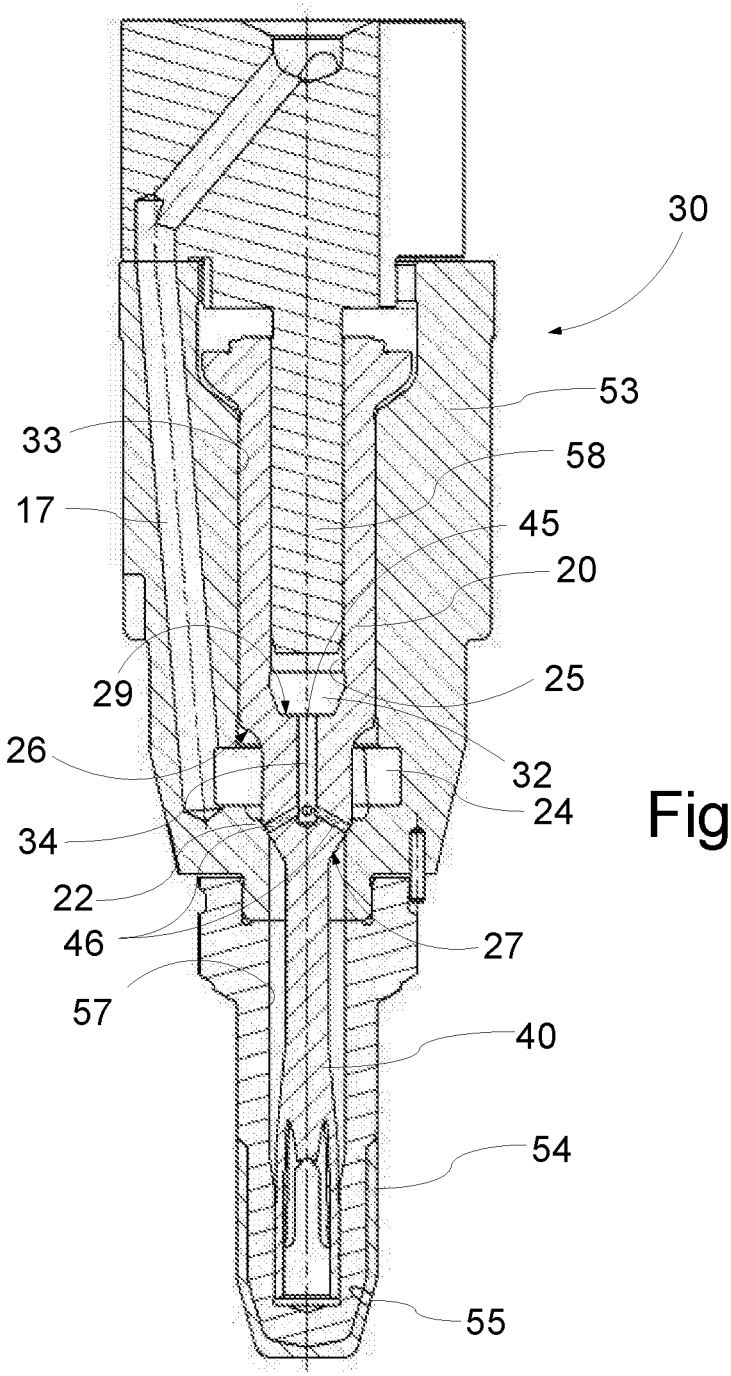
FIG. 6 is a longitudinal-section on a larger scale through the foremost part of the fuel valve illustrated in FIG. 1, the foremost part of the fuel valve being in accordance with yet another example embodiment and the valve needle being shown resting on the valve seat.

The above embodiments can be combined, i.e. as shown in FIG. 6, where the pressure chamber 32 is be defined by a third axial bore 25 in the valve needle 20 and a plunger 58 that is received in the third axial bore 25, in combination with the pressure conduit 34 having second ends 46 that are closed is when the valve needle 20 rests on the valve seat 22.

Alternatively, the second end(s) 46 is (can be) placed such that it opens towards the first bore 57 in the embodiment shown with reference to FIGS. 2 to 4.

Although the teaching of this application has been described in detail for purpose of illustration, it is understood that such detail is solely for that purpose, and variations can be made therein by those skilled in the art without departing from the scope of the teaching of this application.

The term "comprising" as used in the claims does not exclude other elements or steps. The term "a" or "an" as used in the claims does not exclude a plurality. The single processor or other unit may fulfill the functions of several means recited in the claims.

The invention claimed is:

1. A fuel valve (1) for injecting fuel into a combustion chamber of a large two-stroke self-igniting internal combustion engine, said fuel valve comprising:

an elongated valve housing (10) with a rear end and a front end, a hollow nozzle (54) with a first axial bore (57), a plurality of nozzle holes (55) and a closed front, said hollow nozzle (54) being arranged at the front end of said elongated valve housing (10), an axially displaceable valve needle (20) slidably received in a second axial bore (33) in said elongated valve housing (10), said axially displaceable valve needle (20) being configured to control a flow of fuel to the nozzle (54), said axially displaceable valve needle (20) configured to cooperate with a valve seat (22) in said elongated valve housing and said axially displaceable valve needle (20) being resiliently biased towards said valve seat (22) by a resilient bias, a first pressure chamber (24) arranged in said elongated valve housing upstream of said valve seat (22) that surrounds a portion of said axially displaceable valve needle (20) and is connected to a fuel inlet port (16) in said elongated valve housing (10), said axially displaceable valve needle (20) allowing a flow of fuel from said first pressure chamber (24) to said nozzle (54) when said axially displaceable valve needle (20) has lift from said valve seat (22) and said axially displaceable valve needle (20) preventing flow of fuel from said first pressure chamber (24) to said nozzle (54) when said axially displaceable valve needle (20) rests on said valve seat (22), said axially displaceable valve needle (20) when resting on said valve seat (22) having a first effective pressure surface (26) that under influence of fuel pressure causes a first force on said axially displaceable valve needle (20) opposing said resilient bias, wherein said first force overcomes said resilient bias and causes a lift of said axially displaceable valve needle (20) from said valve seat (22) when the fuel pressure in said first pressure chamber (24) exceeds a preset pressure threshold so that the lift of the axially displaceable valve needle (20) is obtained by an increase of the fuel pressure exceeding said preset pressure threshold and a subsequent return of the axially displaceable valve needle (20) to the valve seat (22) is obtained by a subsequent decrease in the fuel pressure, said axially displaceable valve needle (20) when having lift from said valve seat (22) having an additional second effective pressure surface (27) that under influence of fuel pressure causes an additional second force on said axially displaceable valve needle (20) opposing said resilient bias when the valve needle (20) has lift from said valve seat (22), said axially displaceable valve needle moving towards said rear end to have lift from the valve seat, said axially displaceable valve needle (20) being provided with a third effective pressure surface (29) that under influence of fuel pressure in said first pressure chamber (24) causes a third force on said axially displaceable valve needle (20) joining said resilient bias when and only when said axially displaceable valve needle (20) has lift from said valve seat (22), said third effective pressure surface (29) faces a second pressure chamber (32) that is defined between said axially displaceable valve needle (20) and said elongated valve housing (10), said second pressure chamber (32) being a blind pressure chamber with only a single fluidic connection, said single fluidic connection being a conduit (34) in said axially displaceable valve needle (20), said conduit (34) connecting the second pressure chamber (32) fluidically to the first pressure chamber (24) or to said first axial bore (57) when and only when said axially displaceable valve needle (20) has lift, wherein said second pressure chamber (32) is defined by a third axial bore (25) in said axially displaceable valve needle (20) and a first plunger (58) that is received in said third axial bore (25), said first plunger (58) being static and said first plunger (58) sealingly fitting inside said third axial bore (25), or said second pressure chamber (32) is defined by a fourth axial bore (23) in said elongated valve housing (10) and a second plunger (59) that is received in said fourth axial bore (23), said second plunger (59) being part of the axially displaceable valve needle (20) and said second plunger (59) sealingly fitting inside said fourth axial bore (23).

2. A fuel valve (1) according to claim 1, wherein said third effective pressure surface (29) has a size causing said third force to compensate substantially for the additional second force.

3. A fuel valve (1) according to claim 1, wherein a first end (45) of said conduit (34) opens to said second pressure chamber (32) and a second end (46) of said conduit (34) opens to said first axial bore (57) or to a portion (42) of the surface of the axially displaceable valve needle (20) that is in contact with said valve seat (22) when the axially displaceable valve needle (20) rests on said valve seat (22).

4. A fuel valve (1) according to claim 3, wherein said second end (46) is closed when said axially displaceable valve needle (20) rests on said valve seat (22).

5. A fuel valve (1) according to claim 4, wherein said portion (42) and the surface of the valve seat (22) that is in contact with said portion (42) when the axially displaceable valve needle (20) rests on the valve seat (22), are in sealing contact around said second end (46).

6. A fuel valve according to claim 1 wherein said second pressure chamber (32) is defined by a third axial bore (25) in said valve needle (20) and a plunger (58) that is received in said third axial bore (25).

7. A fuel valve (1) according to claim 6, wherein said first plunger (58) is static and wherein said plunger (58) sealingly fits inside said third axial bore (25).

8. A fuel valve (1) according to claim 1, wherein said second plunger (59) is movable and wherein said second plunger (59) sealingly fits inside said fourth axial bore (23).

9. A fuel valve according to claim 1, wherein said plurality of nozzle holes (55) are distributed over the side of said nozzle (54), with all or at least most of the plurality of nozzle holes being closely angularly spaced.

10. A fuel valve according to claim 1, further comprising a hollow cut-off shaft (40) moving in unison with the axially displaceable valve needle (20) and received axially displaceable in the first axial bore (57) in the nozzle (54) for opening and closing the nozzle holes (55), said hollow cut-off shaft (40) being preferably provided with a plurality of openings corresponding to the plurality of nozzle holes (55) so as to connect the plurality of nozzle holes (55) to the interior of the hollow cut-off shaft (40) in one position of the hollow cut-off shaft and to disconnect the plurality of nozzle (55) holes from the interior of the hollow cut-off shaft (40) in another position of the hollow cut-off shaft.

11. A fuel valve according to claim 1, said elongated valve housing (10) being provided with a head (14) at its rearmost end for securing the fuel valve (1) to a cylinder cover of a cylinder of a large two-stroke self-igniting internal combustion engine.

* * * * *